US009081346B2

(12) United States Patent
Miyahara et al.

(10) Patent No.: US 9,081,346 B2
(45) Date of Patent: Jul. 14, 2015

(54) IMAGE FORMING APPARATUS

(71) Applicants: Kensuke Miyahara, Nagoya (JP); Toshio Furukawa, Nagoya (JP)

(72) Inventors: Kensuke Miyahara, Nagoya (JP); Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 135 days.

(21) Appl. No.: 13/802,884

(22) Filed: Mar. 14, 2013

(65) Prior Publication Data

US 2013/0243447 A1 Sep. 19, 2013

(30) Foreign Application Priority Data

Mar. 14, 2012 (JP) ..... 2012-056828

(51) Int. Cl.

*G03G 15/00* (2006.01)
*G03G 21/10* (2006.01)
*G03G 21/00* (2006.01)
*G03G 21/16* (2006.01)

(52) U.S. Cl.

CPC ..... *G03G 15/55* (2013.01); *G03G 15/50* (2013.01); *G03G 21/0076* (2013.01); *G03G 21/1638* (2013.01)

(58) Field of Classification Search

CPC ..... G03G 21/10; G03G 21/0076; G03G 21/1638; G03G 15/00; G03G 15/55; G03G 15/50

USPC ..... 399/21, 34

See application file for complete search history.

(56) References Cited

U.S. PATENT DOCUMENTS

| | | | | |
|---|---|---|---|---|
| 4,269,503 | A * | 5/1981 | Nishikawa | 399/145 |
| 5,093,688 | A * | 3/1992 | Komiya et al. | 399/78 |
| 5,606,408 | A * | 2/1997 | Yano et al. | 399/343 |
| 5,790,920 | A * | 8/1998 | Teramura et al. | 399/71 |
| 7,539,432 | B2 | 5/2009 | Dan | |
| 2002/0056957 | A1 | 5/2002 | Sekine | |
| 2006/0245782 | A1 * | 11/2006 | Hirai et al. | 399/101 |

(Continued)

FOREIGN PATENT DOCUMENTS

| | | | | |
|---|---|---|---|---|
| JP | 04067161 | A * | 3/1992 | G03G 15/00 |
| JP | 04156559 | A * | 5/1992 | G03G 15/00 |

(Continued)

OTHER PUBLICATIONS

Sep. 18, 2014—(US) Notice of Allowance—U.S. Appl. No. 13/954,103.

(Continued)

*Primary Examiner* — Nguyen Ha
(74) *Attorney, Agent, or Firm* — Banner & Witcoff, Ltd.

(57) ABSTRACT

An image forming apparatus includes a control device executing: a holding process of holding developer attached on an image carrier at a holding member; a moving process of moving the developer from the holding member to the image carrier; and a collection process of collecting the developer attached on the image carrier into a collection member. The control device executes the moving process and the collection process after completing printing. The control device sets a first flag when predetermined time period elapses from start of the moving process and unsets the first flag at start of the printing. When the first flag is not set at a startup time, the control device executes the moving process and the collection process before the printing. When the first flag is set, the control device omits the moving process before the printing.

15 Claims, 7 Drawing Sheets

(56) References Cited

U.S. PATENT DOCUMENTS

| | | | | |
|---|---|---|---|---|
| 2006/0285873 | A1 | 12/2006 | Saeki | |
| 2008/0008489 | A1* | 1/2008 | Watanabe et al. | 399/71 |
| 2008/0031649 | A1 | 2/2008 | Dan | |
| 2008/0292330 | A1* | 11/2008 | Kabashima et al. | 399/21 |
| 2011/0255902 | A1* | 10/2011 | Sato et al. | 399/123 |
| 2012/0002996 | A1* | 1/2012 | Izumi et al. | 399/88 |
| 2014/0037316 | A1* | 2/2014 | Miyahara et al. | 399/71 |
| 2014/0119759 | A1* | 5/2014 | Yamaura et al. | 399/66 |

FOREIGN PATENT DOCUMENTS

| | | | | | |
|---|---|---|---|---|---|
| JP | 08160812 | A | * | 6/1996 | G03G 21/00 |
| JP | H09-190079 | A | | 7/1997 | |
| JP | 10-221978 | A | | 8/1998 | |
| JP | 11-305624 | A | | 11/1999 | |
| JP | 2004029148 | A | * | 1/2004 | G03G 21/10 |
| JP | 2004118095 | A | * | 4/2004 | G03G 21/10 |
| JP | 2006058703 | A | * | 3/2006 | G03G 21/10 |
| JP | 2008-039905 | A | | 2/2008 | |
| JP | 04-532935 | B2 | | 8/2010 | |
| JP | 2012-056828 | A | | 3/2012 | |
| JP | 2012247535 | A | * | 12/2012 | G03G 21/14 |

OTHER PUBLICATIONS

Apr. 20, 2015—(US) Non-Final Office Action—U.S. Appl. No. 13/954,103.

Jan. 23, 2015—(US) Notice of Allowance—U.S. Appl. No. 13/954,103.

Jan. 23, 2015—(US) Notice of Allowance—U.S. Appl. No. 14/169,170.

* cited by examiner

IMAGE FORMING APPARATUS

CROSS-REFERENCE TO RELATED APPLICATIONS

This application claims priority from Japanese Patent Application No. 2012-056828 filed on Mar. 14, 2012, the entire subject matter of which is incorporated herein by reference.

TECHNICAL FIELD

The invention relates to an image forming apparatus having a holding member configured to temporarily hold developer attached on an image carrier.

BACKGROUND

There have been proposed an image forming apparatus configured to execute: an operation of temporarily collecting (holding) residual toner, which is attached on a photosensitive drum, by a cleaning roller (holding member) during a printing and to execute an operation (moving operation) of moving the toner, which is held by the holding member, to the photosensitive drum; and an operation (collection operation) of collecting the toner, which is attached on the photosensitive drum, through a conveyance belt by a belt cleaner after the printing and the like.

The moving operation and the collection operation are also executed at the startup time of the image forming apparatus, for example, when a cover, which has been opened so as to perform sheet jamming processing (jamming processing) caused during the printing, is closed. The reason is as follows: that is, since the toner, which has been collected before the jamming processing, is already held on the holding member, there is a possibility that it may not be possible to completely collect the toner on the photosensitive drum when the printing is resumed after the jamming processing.

SUMMARY

Illustrative aspects of the invention provide an image forming apparatus capable of shortening time that is consumed until the image forming apparatus is subject to a printable state while suppressing an image quality from being deteriorated.

According to one illustrative aspect of the invention, there is provided an image forming apparatus comprising: an image carrier configured to carry a developer image; a holding member configured to hold developer attached on the image carrier and to move the held developer to the image carrier; a collection member configured to collect the developer attached on the image carrier into a collection receptacle; and a control device. The control device is configured to execute: a holding process of holding the developer attached on the image carrier at the holding member; a moving process of moving the developer held by the holding member to the image carrier; and a collection process of collecting the developer attached on the image carrier into the collection member, the control device being configured to execute the holding process during a printing, and the control device being configured to execute the moving process and the collection process after completion of the printing. The control device is configured to set a first flag when predetermined time period elapses from start of the moving process and to unset the first flag at the start of the printing. When the first flag is not set at startup time of the image forming apparatus, the control device is configured to execute the moving process and the collection process before the printing after startup of the image forming apparatus. When the first flag is set at the startup time of the image forming apparatus, the control device is configured to omit the moving process before the printing after the startup.

DETAILED DESCRIPTION

<General Overview>

Figure 1:
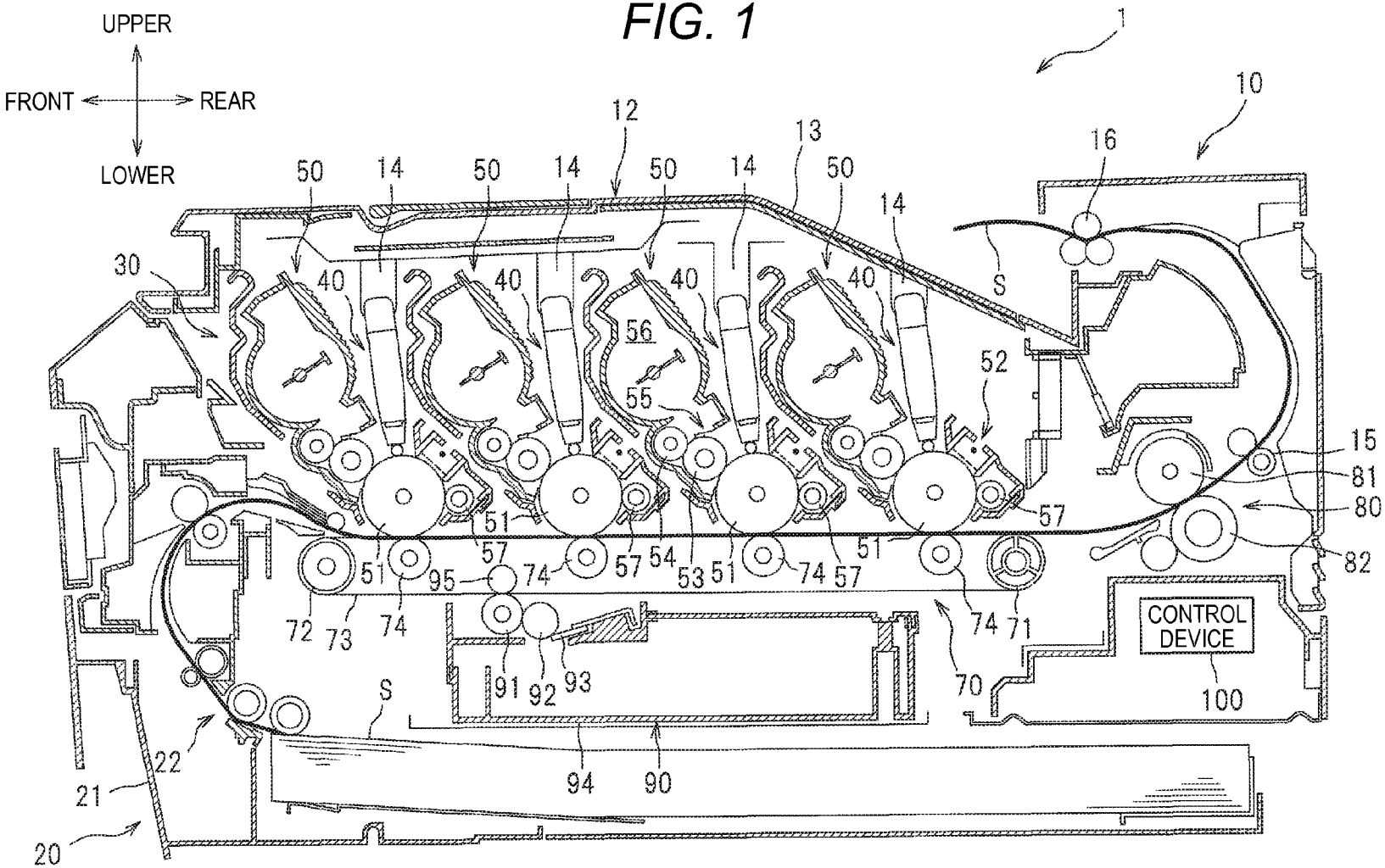
FIG. 1 shows a schematic configuration of a color printer that is an example of the image forming apparatus according to an exemplary embodiment of the invention.

In the related-art image forming apparatus, when the moving operation and the like are executed at the startup time, since it may not be possible to execute the printing until the corresponding operation is over, it may take time until the image forming apparatus is subject to a printable state. On the other hand, if the moving operation is not executed at the startup time, it may be possible to shorten the time that is consumed until the image forming apparatus is subject to a printable state. However, there is a possibility that the holding member will not be able to completely collect the toner on the photosensitive drum. When the holding member is unable to completely collect the toner on the photosensitive drum, the toner remaining on the photosensitive drum may be attached to a sheet to thus deteriorate an image quality.

Therefore, illustrative aspects of the invention provide an image forming apparatus capable of shortening time that is consumed until the image forming apparatus is subject to a printable state while suppressing an image quality from being deteriorated.

According to one illustrative aspect of the invention, there is provided an image forming apparatus comprising: an image carrier configured to carry a developer image; a holding member configured to hold developer attached on the image carrier and to move the held developer to the image carrier; a collection member configured to collect the developer attached on the image carrier into a collection receptacle; and a control device. The control device is configured to execute: a holding process of holding the developer attached on the image carrier at the holding member; a moving process of moving the developer held by the holding member to the image carrier; and a collection process of collecting the developer attached on the image carrier into the collection member, the control device being configured to execute the holding process during a printing, and the control device being configured to execute the moving process and the collection process after completion of the printing. The control device is configured to set a first flag when predetermined time period elapses from start of the moving process and to unset the first flag at the start of the printing. When the first flag is not set at startup time of the image forming apparatus, the control device is configured to execute the moving process and the collection process before the printing after startup of the image forming apparatus. When the first flag is set at the startup time of the image forming apparatus, the control device is configured to omit the moving process before the printing after the startup.

According to this configuration, when the first flag is not set at the startup time, e.g., when it is considered that the holding member holds much developer, the moving process and the collection process are executed before the printing after the startup. Therefore, it is possible to reduce an amount of the developer attached on the holding member or image carrier, thereby suppressing the image quality from being deteriorated. On the other hand, when the first flag is set at the startup time, e.g., when it is considered that the holding member holds little developer, the moving process is omitted before the printing after the startup. Therefore, it is possible to shorten the time that is consumed until the image forming apparatus is subject to a printable state.

According to another illustrative aspect of the invention, the image forming apparatus comprises a plurality of the image carriers and is configured to execute a color printing and a monochrome printing. The control device is configured to: unset the first flag at the start of the printing when performing the color printing; and hold the first flag as it is set when performing the monochrome printing.

According to this configuration, for example, when the jamming processing is made during the monochrome printing control and then the image forming apparatus starts, the moving process is omitted before the printing after the startup. Therefore, it is possible to shorten the time that is consumed until the image forming apparatus is subject to a printable state (until a printing is resumed). Incidentally, in the case of the monochrome printing, the total amount of the developer that is held by the holding member is less than that of the color printing. Therefore, even through the moving process is omitted before the printing after the startup, the holding member is able to hold a sufficient amount of the developer, so that the problem of the deterioration of the image quality is little caused.

According to still another illustrative aspect of the invention, when the first flag is set at the startup time of the image forming apparatus, the control device is configured to execute the collection process before the printing after the startup.

According to this configuration, since it is possible to collect the developer attached on the image carrier by the collection member before the printing after the startup, it is possible to further suppress the image quality from being degraded. Incidentally, since the moving process is omitted by the above configuration, it is possible to shorten the time that is consumed until the image forming apparatus is subject to a printable state.

According to still another illustrative aspect of the invention, when the first flag is set at the startup time of the image forming apparatus, the control device is configured to execute the collection process and the holding process at the same time before the printing after the startup.

According to this configuration, since it is possible to collect the developer attached on the image carrier by the collection member and the holding member before the printing after the startup, it is possible to further suppress the image quality from being degraded. Incidentally, since the moving process is omitted by the above configuration, it is possible to shorten the time that is consumed until the image forming apparatus is subject to a printable state.

According to still another illustrative aspect of the invention, the image forming apparatus further comprises: a plurality of the image carriers; and an endless belt that is opposed to the image carriers. The collection member is configured to collect the developer attached on the image carriers via the belt. As the collection process, the control device is configured to execute: a first collection process of moving the developer attached on the image carriers to the belt; and a second collection process of collecting the developer attached on the belt into the collection member. The control device is configured to set a second flag when the first collection process is completed. When the first flag is set at the startup time of the image forming apparatus, in a case where the second flag is not set, the control device is configured to execute the first collection process and the second collection process before the printing after the startup, and in a case where the second flag is set, the control device is configured to omit the first collection process and to execute the second collection process before the printing after the startup.

According to this configuration, when the second flag is not set at the startup time, e.g., when the developer is attached on the image carrier, the first collection process is executed before the printing after the startup. Therefore, it is possible to collect the developer attached on the image carrier, thereby suppressing the image quality from being deteriorated. On the other hand, when the second flag is set at the startup time, e.g., when the developer is little attached on the image carrier, the first collection process is omitted before the printing after the startup. Therefore, it is possible to shorten the time that is consumed until the image forming apparatus is subject to a printable state. Incidentally, in any case, since the second collection process of collecting the developer attached on the belt is executed, it is possible to suppress the image quality from being deteriorated, which is caused as the developer attached on the belt is attached to the sheet.

According to still another illustrative aspect of the invention, the image forming apparatus comprises a plurality of the image carriers and is configured to execute a color printing and a monochrome printing. The control device is configured to: unset the first flag, the second flag and the third flag at the start of the printing when performing the color printing; and unset the second flag and the third flag when performing the monochrome printing.

According to still another illustrative aspect of the invention, when the predetermined time period elapses, the control device is configured to complete the moving process and to set the first flag.

According to still another illustrative aspect of the invention, the control device is configured to set the first flag when the predetermined time period elapses and to complete the moving process when a first time period, which is longer than the predetermined time period, elapses.

According to the illustrative aspects of the invention, it is possible to shorten the time that is consumed until the image forming apparatus is subject to a printable state.

<Exemplary Embodiments>

Exemplary embodiments of the invention will now be described with reference to the drawings.

[First Exemplary Embodiment]

Hereinafter, a first exemplary embodiment of the invention will be described. Incidentally, in the below descriptions, a schematic configuration of a color printer 1, which is an example of the image forming apparatus according to an exemplary embodiment, will be briefly described, and then a specific configuration of the color printer 1 will be described.

Further, in the below descriptions, the directions are described on the basis of a user who uses the color printer 1.

That is, the left of FIG. 1 is referred to as the 'front,' the right of FIG. 1 is referred to as the 'rear,' the front side of FIG. 1 is referred to as the 'right' and the inner side of FIG. 1 is referred to as the 'left.' Further, the upper and lower directions of FIG. 1 are referred to as the 'upper-lower.'

(Schematic Configuration of Color Printer)

As shown in FIG. 1, the color printer 1 includes, in a body housing 10, a feeder unit 20, an image forming unit 30 and a collection unit 90. The body housing 10 is provided at its upper side with an upper cover 12 that is configured to be rotatable (openable/closeable) in the upper-lower direction at a rear side serving as a support point.

The feeder unit 20 is provided at the lower in the body housing 10. The feeder unit 20 includes a sheet feeding tray 21 configured to accommodate therein sheets S and a feeding mechanism 22 configured to feed the sheets S from the sheet feeding tray 21 to the image forming unit 30. The sheets S in the sheet feeding tray 21 are separated and fed one at a time to the image forming unit 30 by the feeding mechanism 22.

The image forming unit 30 includes four LED units 40, four process units 50, a transfer unit 70 and a fixing unit 80.

The LED unit 40 is arranged to face a photosensitive drum 51 from the upper of the photosensitive drum. The LED unit 40 includes, at a lower end thereof, a plurality of LEDs (not shown) that is arranged in the left-right direction. The LED unit 40 is configured to expose a surface of the photosensitive drum 51 as a light emission unit thereof turns on and off on the basis of image data. Further, the LED unit 40 is held at the upper cover 12 via a holder 14 and is spaced from the photosensitive drum 51 as the upper cover 12 is opened.

The process units 50 are arranged side by side in the front-rear direction between the upper cover 12 and the sheet feeding tray 21. The process units 50 are configured to be mounted and removed to and from the body housing 10 at a state where the upper cover 12 is opened. Each process unit 50 includes the photosensitive drum 51, which is an example of the image carrier, a charger 52, a developing roller 53, a supply roller 54, a layer thickness regulation blade 55, a toner accommodation part 56 configured to accommodate therein positively charged toner (developer) and a holding roller 57 that is an example of the holding member.

The holding roller 57 is a roller configured to temporarily collect (hold) the toner attached on the photosensitive drum 51 and to move the held toner to the photosensitive drum 51. The holding roller 57 has a configuration where a metallic rotary shaft is covered with a roller body made of a conductive foamed elastic body, e.g., a foamed elastic layer is provided on an outer peripheral part.

The transfer unit 70 is provided between the feeder unit 20 and the process units 50. The transfer unit includes a driving roller 71, a driven roller 72, a conveyance belt 73 that is an example of the endless belt and four transfer rollers 74. The conveyance belt 73 is provided in a tensioned state between the driving roller 71 and the driven roller 72, an outer surface thereof is opposed to the respective photosensitive drums 51 and the respective transfer roller 74 are arranged to sandwich the conveyance belt 73 at an inside of the belt between the transfer rollers 74 and the photosensitive drums 51.

The fixing unit 80 is provided at the rear of the process units 50 and the transfer unit 70. The fixing unit 80 includes a heating roller 81 and a pressing roller 82 that is arranged to face the heating roller 81 and is configured to press the heating roller 81.

The collection unit 90 is provided below the conveyance belt 73. The collection unit 90 includes a first collection roller 91, a second collection roller 92 and a scraping blade 93, which are an example of the collection member, a toner storage part 94 that is an example of the collection receptacle and a backup roller 95 that is configured to sandwich the conveyance belt 73 between the backup roller 95 and the first collection roller 91.

The first collection roller 91 is a roller configured to collect the toner attached on the conveyance belt 73 as a predetermined bias is applied between the first collection roller and the backup roller 95. The first collection roller 91 has a configuration where a metallic rotary shaft is covered with a roller body made of a conductive foamed elastic body, e.g., a foamed elastic layer is provided on an outer peripheral part. The second collection roller 92 is a metallic roller configured to collect the toner attached on the first collection roller 91. Further, the scraping blade 93 is a member configured to scrape the toner attached on the second collection roller 92. The toner scraped from a surface of the second collection roller 92 by the scraping blade 93 is stored (collected) in the toner storage part 94.

(Outlines of Operations of Color Printer)

In the below, operations that are executed in the color printer 1, specifically, printing, holding, moving and collection operations are outlined.

The printing operation is an operation of forming an image on the sheet S. The printing operation starts when a print job including image data is input from an external apparatus such as personal computer (not shown). Specifically, during the printing operation, the surfaces of the photosensitive drums 51 being rotated are uniformly positively charged by the chargers 52 and are then exposed by the LED units 40, so that electrostatic latent images based on the image data are formed on the photosensitive drums 51. Further, at this time, the toner in the toner accommodation parts 56 is supplied to the developing rollers 53 via the supply rollers 54 and is introduced between the developing rollers 53 and the layer thickness regulation blades 55, so that it is carried on the developing rollers 53 as a thin layer having a predetermined thickness.

The toner carried on the developing rollers 53, to which a developing bias is applied, is supplied to the photosensitive drums 51 having the electrostatic latent images formed thereon, so that the electrostatic latent images become visible and toner images (developer images) are formed on the photosensitive drums 51. Further, the feeding mechanism 22 feeds the sheet S, which is accommodated in the sheet feeding tray 21, to the image forming unit 30 at appropriate timing up to now. The sheet S fed from the feeder unit 20 is conveyed between the photosensitive drums 51 and the conveyance belt 73 (the transfer rollers 74 to which a transfer bias is applied), so that the toner images formed on the respective photosensitive drums 51 are transferred to the sheet S.

After that, the sheet S having the toner images transferred thereto is conveyed between the heating roller 81 and the pressing roller 82, so that the toner images are heat-fixed. The sheet S having the toner images heat-fixed thereon (having an image formed thereon) is discharged to the outside from the body housing 10 by conveyance rollers 15 and discharge rollers 16 and is placed on a sheet discharge tray 13.

The holding operation is an operation of holding the toner, which is attached (remains without being transferred) on the photosensitive drums 51, on the holding rollers 57, in other words, an operation of simply cleaning the photosensitive drums 51. The holding operation is executed during the printing operation and the like, for example. Specifically, during the holding operation, the holding rollers 57 and the photosensitive drums 51 are rotated with the holding rollers 57 being applied with a holding bias (a positive or negative bias lower than a surface potential of the photosensitive drums 51). Thereby, the toner on the photosensitive drums 51 is moved to and held on the holding rollers 57.

The moving operation is an operation of moving the toner, which is held on the holding rollers 57, to the photosensitive drums 51, in other words, an operation of cleaning the holding rollers 57. The moving operation is executed after the printing operation is over, and the like, for example. Specifically, during the moving operation, the holding rollers 57 and the photosensitive drums 51 are rotated with the holding rollers 57 being applied with a discharge bias (a positive bias higher than the surface potential of the photosensitive drums 51). Thereby, the toner held on the holding rollers 57 is moved to the photosensitive drums 51.

The collection operation is an operation of collecting the toner, which is attached on the photosensitive drums 51 or conveyance belt 73, into the collection unit 90, in other words, an operation of cleaning the photosensitive drums 51 or conveyance belt 73. The collecting operation is executed after the printing operation is over, and the like, for example. The color printer 1 of this exemplary embodiment is configured to execute, as the collection operation, a first collection operation of moving the toner on the photosensitive drums 51 to the conveyance belt 73 and a second collection operation of collecting the toner on the conveyance belt 73 into the collection unit 90.

Specifically, during the first collection operation, the photosensitive drums 51, the conveyance belt 73 and the like are rotated with the transfer rollers 74 being applied with a transfer bias (a negative bias). Thereby, the toner held on the photosensitive drums 51 is moved to the conveyance belt 73. Further, during the second collection operation, the conveyance belt 73, the first collection roller 91 and the like are rotated with a bias being applied between the first collection roller 91 and the backup roller 95. Thereby, the toner on the conveyance belt 73 is moved to the first collection roller 91, so that it is finally collected into the toner storage part 94. Incidentally, regarding the collection operation, when the first collection operation is omitted and only the second collection operation (a second collection process) is executed, since the toner is suppressed from being moved from the photosensitive drums 51 to the conveyance belt 73, the transfer bias is not applied to the transfer rollers 74.

(Specific Configuration of Color Printer)

The color printer 1 further includes a control device 100, in addition to the photosensitive drums 51, the holding rollers 57, the transfer unit 70 and the collection unit 90.

The control device 100 is a device for controlling operations of the color printer 1. The control device 100 is arranged at an appropriate position in the body housing 10. The control device 100 includes a CPU, a RAM, a ROM, an input/output interface and the like, which are not shown, and is configured to execute respective calculation processing on the basis of detection results of various sensors, preset programs and the like, thereby executing the control.

Specifically, the control device 100 executes printing control of executing the printing operation when a print job is input and a holding process of executing the holding operation during the printing operation. Further, the control device 100 executes a moving process of executing the moving operation and a collection process (a first collection process and a second collection process) of executing the collection operation when a sensor (not shown) detects that a last sheet S, on which an image is formed based on the input print job, is discharged to the outside of the body housing 10 after the printing operation is over.

Further, when the color printer 1 starts, for example when a power supply switch of the color printer 1 becomes on, when a sensor (not shown) detects that the opened upper cover 12 is closed, and the like, the control device 100 is configured to execute different controls of four patterns (1) to (4) (which will be described later) in accordance with states of first to third flags or opening/closing history of the upper cover 12 (which will be described later).

The opening/closing history of the upper cover 12 is information indicating that the closed upper cover 12 is opened and then again closed. The opening/closing history may be acquired based on an input from a sensor detecting the opening/closing of the upper cover or may be acquired by adopting a configuration capable of mechanically leaving the opening/closing history of the upper cover 12 and detecting a state of the configuration with a sensor and the like. According to the latter, even when the upper cover 12 is opened/closed while the power supply of the color printer 1 is off, it is possible to acquire the opening/closing history. Incidentally, since the configuration of mechanically leaving the opening/closing history of the upper cover 12 is well known, the descriptions of the specific configuration thereof are here omitted.

In the below, the basic control of the color printer 1 will be described with reference to FIGS. 2A and 3, except for the startup of the color printer 1, and then the control that is executed when the color printer 1 starts will be specifically described.

[Basic Control of Color Printer]

After executing the control at the startup time (which will be described later), the control device 100 repeatedly executes processing of a flowchart shown in FIG. 3.

More specifically, when a print job is input (Yes in S101), the control device 100 starts the printing control and the holding process (S 102). Further, the control device 100 is configured to unset first to third flags at the start of the printing operation (S103). Incidentally, the timing of unsetting the first to third flags is not limited to the moment of starting the printing operation. The timing of unsetting the first to third flags may be timing at which a print job is input before the printing operation starts, timing just after the color printer 1 starts the printing operation, and the like, for example.

When the printing is over (Yes in S104), the control device 100 starts the moving process and the collection process (S105). Specifically, as shown in FIG. 2A, after the printing is over, the control device 100 starts the moving process the first collection process and the second collection process (time t11, t12). Incidentally, in FIG. 2A, the first collection process starts (time t12) slightly later than the moving process and the second collection process. However, the first collection process may start (time t11) simultaneously with the moving process and the second collection process.

After preset first time period T1 (for example, time period during which the holding roller 57 rotates several times) elapses from the start of the moving process, the control device 100 ends (completes) the moving process. When the moving process is completed (Yes in S106), the control device 100 sets the first flag (time t13, S107). Incidentally, in FIG. 2A, the holding process is executed after the moving process is completed until the second collection process is completed (refer to time t13 to t15). However, it is arbitrary whether or not to execute the holding process after the completion of the moving process.

Further, after preset second time T2 (for example, time during which the photosensitive drum 51 rotates several times) elapses from the start (time t12) of the first collection process, the control device 100 completes the first collection process. When the first collection process is completed (Yes in S108), the control device 100 sets the second flag (time t14, S109).

Further, after preset third time T3 (for example, time during which it can be considered that most of the toner on the conveyance belt 73 is collected by the collection unit 90) elapses from the start of the second collection process, the control device 100 completes the second collection process. When the second collection process is completed (Yes in S110), the control device 100 sets the third flag (time t15, S111).

[Control at Startup Time of Color Printer]

Subsequently, the control at the startup time of the color printer 1, which is the features of the invention, will be described.

(1) When the first flag is not set at the startup time of the color printer 1, the control device 100 executes the moving process and the collection process (both the first collection process and the second collection process) before the printing operation that is executed for the first time after the startup.

Figure 2A:
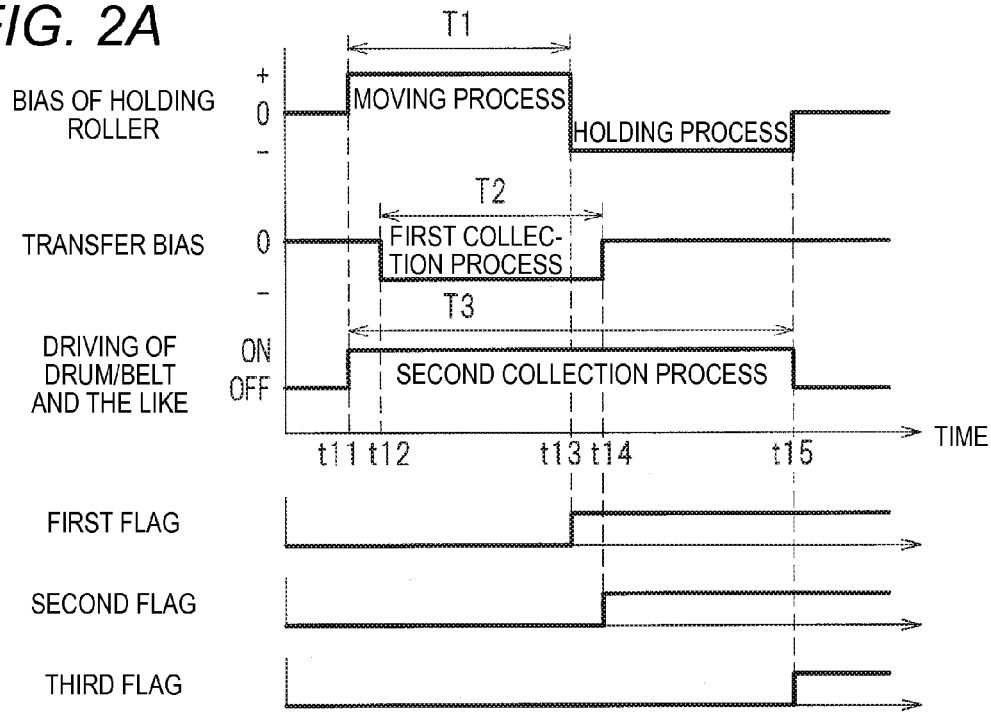
FIGS. 2A to 2C are time charts showing control of the color printer.
Figure 3:
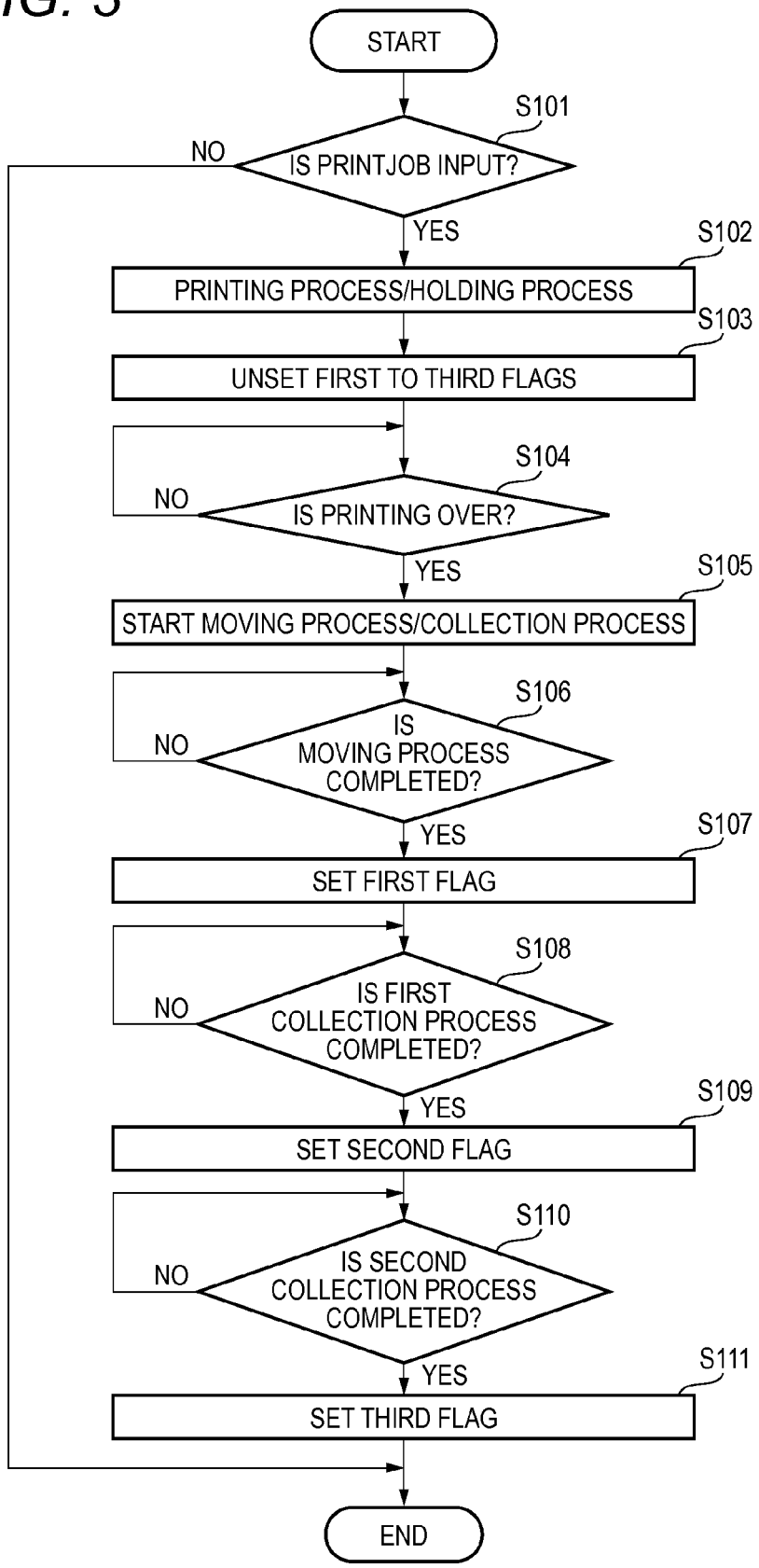
FIG. 3 is a flowchart showing the control of the color printer.

Specifically, as shown in FIG. 2A, the control device 100 starts the moving process, the first collection process and the second collection process (time t11, t12), completes the moving process (time t13) as the first time period T1 elapses, completes the first collection process (time t14) as the second time T2 elapses and completes the second collection process (time t15) as the third time T3 elapses. That is, when the first flag is not set at the startup time of the color printer 1, the control device 100 executes the same control as that of after the printing operation is over.

(2) When the first flag is set at the startup time of the color printer 1, the control device 100 omits the moving process before the printing operation that is executed for the first time after the startup. The reason is as follows: that is, when the first flag is set at the startup time of the color printer 1, since the moving process has been completed, the holding rollers 57 have been cleaned. In this case, when there is the opening/closing history of the upper cover 12 or when the second flag is not set, the control device 100 executes the holding process and the collection process (both the first collection process and the second collection process) at the same time, before the printing operation that is executed for the first time after the startup.

Figure 2B:
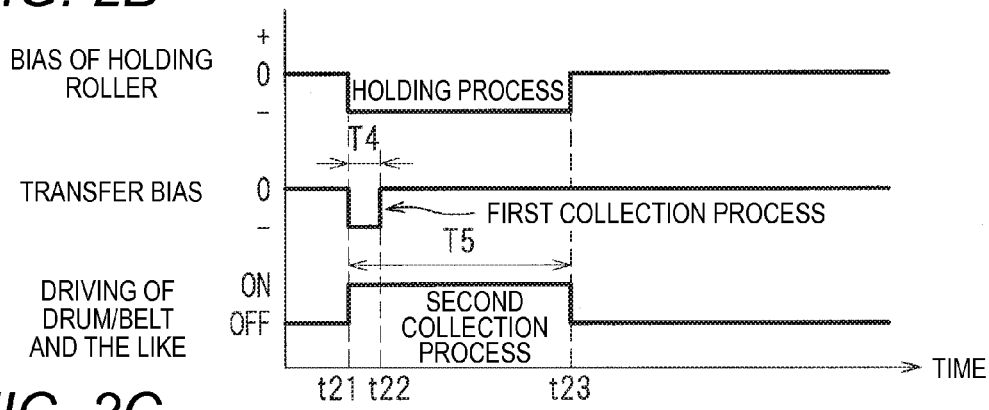

Specifically, as shown in FIG. 2B, the control device 100 starts the holding process, the first collection process and the second collection process (time t21). After preset fourth time T4 (for example, time during which the photosensitive drum 51 rotates one revolution) elapses from the start of the first collection process, the control device 100 completes the first collection process (time t22). Further, after preset fifth time T5 (for example, time during which it can be considered that most of the toner on the conveyance belt 73 is collected by the collection unit 90) elapses from the start of the second collection process, the control device 100 completes the second collection process and the holding process (time t23).

(3) When the first and second flags are set at the startup time, the control device 100 omits the moving process and the first collection process before the printing operation that is executed for the first time after the startup. The reason is as follows: that is, when the first and second flags are set at the startup time, since the moving process and the first collection process have been completed before the startup, the holding rollers 57 or photosensitive drums 51 have been cleaned. In this case, when the third flag is not set, the control device 100 executes the holding process and the collection process (only the second collection process) at the same time, before the printing operation that is executed for the first time after the startup.

Figure 2C:
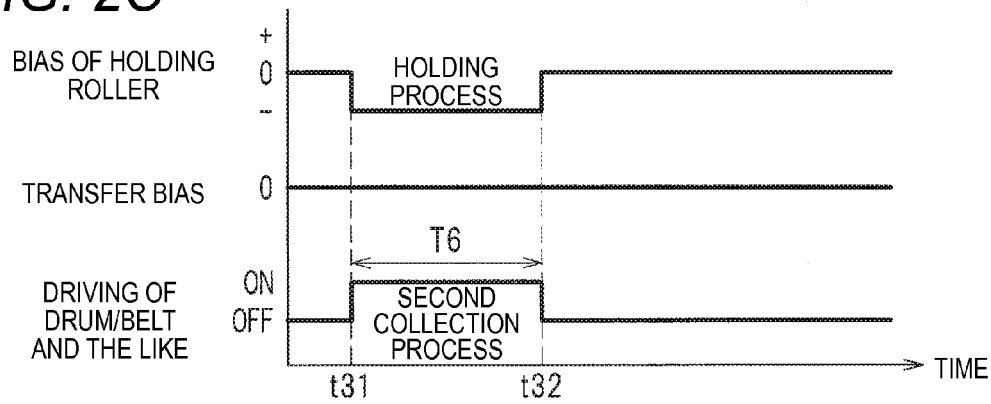

Specifically, as shown in FIG. 2C, the control device 100 starts the holding process and the second collection process (time t31). After preset sixth time T6 (for example, time during which it can be considered that most of the toner on the conveyance belt 73 is collected by the collection unit 90) elapses from the start of the second collection process, the control device 100 completes the second collection process and the holding process (time t32).

(4) When all of the first to third flags are set at the startup time, the control device 100 omits the moving process, the first collection process, the second collection process and the holding process before the printing operation that is executed for the first time after the startup. The reason is as follows: that is, when the first to third flags are set at the startup time, since all of the moving process, the first collection process and the second collection process have been completed, all of the holding rollers 57, the photosensitive drums 51 and the conveyance belt 73 have been cleaned.

Subsequently, the control at the startup time of the color printer 1 will be more specifically described using time charts shown in FIG. 4 and a flowchart shown in FIG. 5.

Figure 4A:
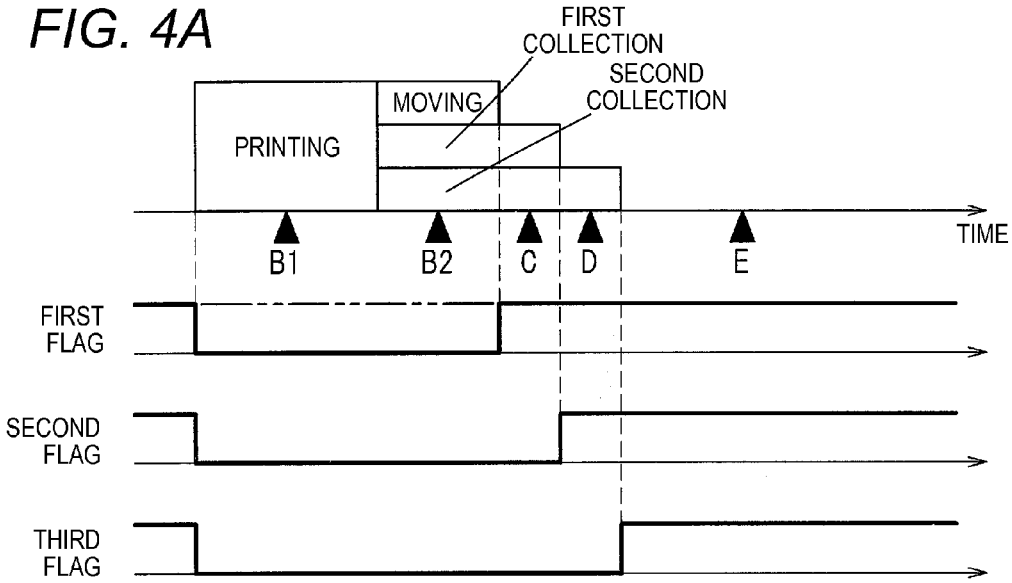
FIGS. 4A to 4E are time charts for illustrating control at the startup time of the color printer.
Figure 4B:
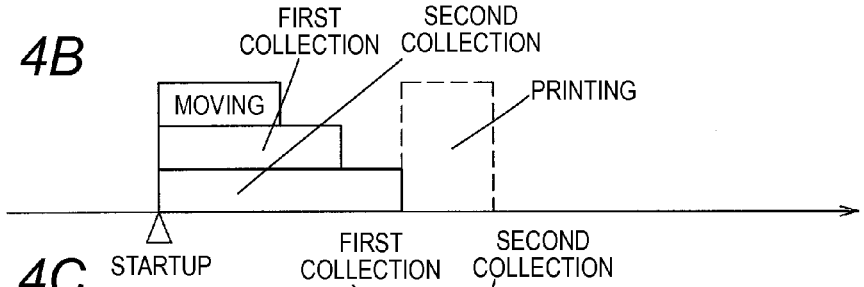
Figure 5:
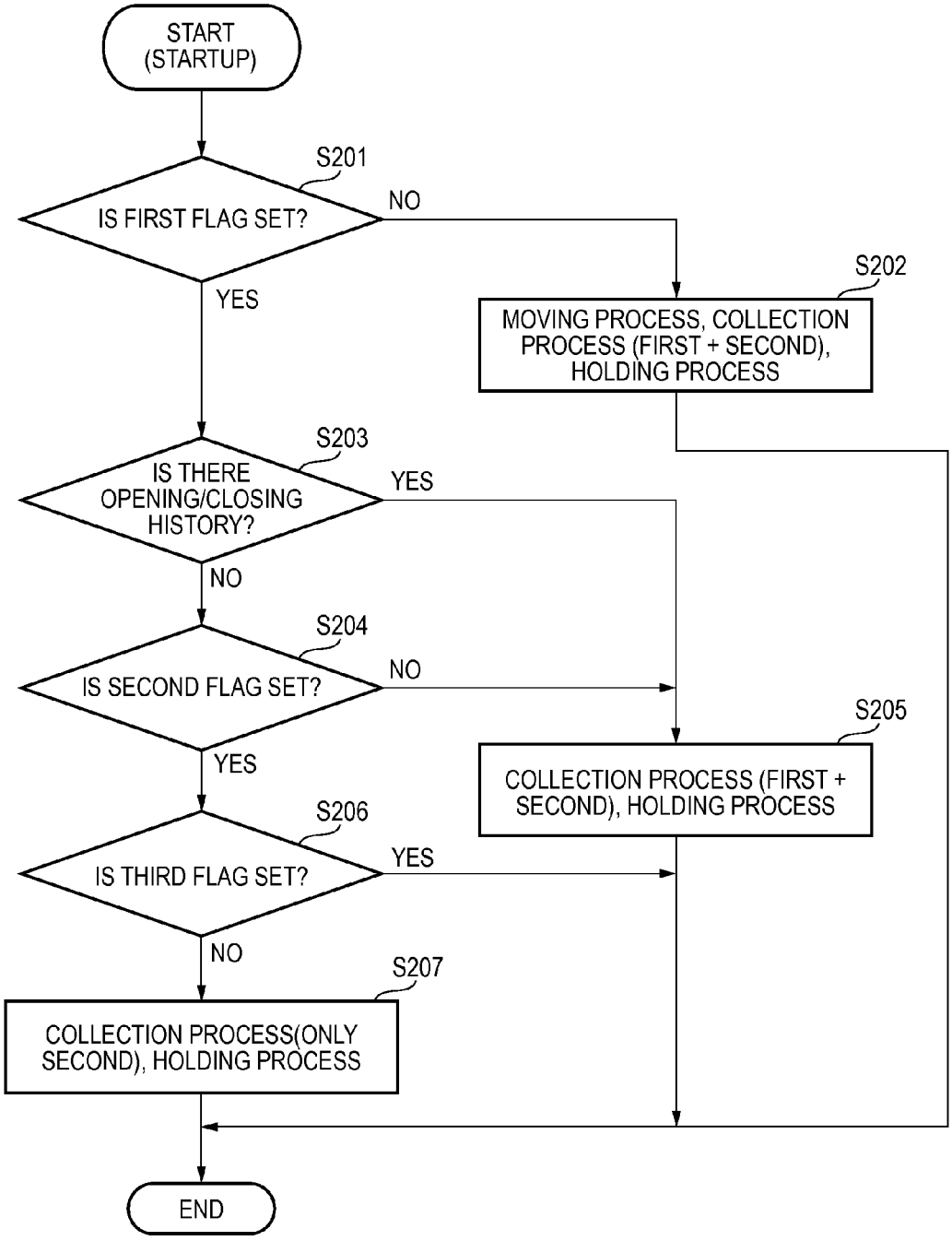
FIG. 5 is a flowchart showing the control at the startup time of the color printer.

As shown with a time point B1 of FIG. 4A, when a jam occurs, for example, during the printing control, and a user opens the upper cover 12 to thus remove the jammed sheet S and then closes the upper cover 12, the color printer 1 starts, as shown in FIG. 4B. At this time, the first flag is not set (No in S201 of FIG. 5). Therefore, as shown in FIG. 4B, the control device 100 starts the moving process, the first collection process, the second collection process and the holding process (not shown) (S202, refer to FIG. 2A), like the case of the printing completion. Then, after all of the moving process, the first collection process, the second collection process and the holding process are completed, the control device 100 resumes the printing control that has been interrupted due to the jamming.

Further, as shown with a time point B2 of FIG. 4A, even when the color printer 1 starts as the upper cover 12 is opened and then closed, for example, during the moving process, since the first flag is not set (No in S201), the control device 100 starts the moving process, the first collection process, the second collection process and the holding process (not shown) (S202), as described above. Then, after all the controls are completed, the color printer 1 is subject to a printable state.

Figure 4C:
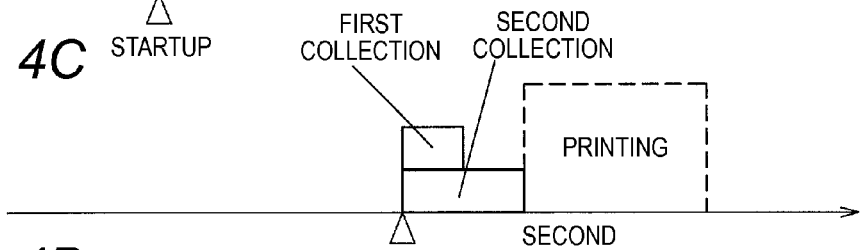

As shown with a time point C of FIG. 4A, when the upper cover 12 is opened and then closed during the first collection process after the completion of the moving process, the color printer 1 starts. At this time, the first flag is set but the second flag is not set. Further, there is the opening/closing history of the upper cover 12. When the first flag is set (Yes in S201), the control device proceeds to step S203. Since there is the opening/closing history of the upper cover 12 (Yes in S203), the control device 100 starts the first collection process, the second collection process and the holding process (not shown) (S205, refer to FIG. 2B), as shown in FIG. 4C, irrespective of whether the second and third flags are set. Then, after all of the first collection process, the second collection process and the holding process are completed, the color printer 1 is subject to a printable state.

Here, when there is the opening/closing history of the upper cover 12, the control device executes both the first collection process and the second collection process, irrespective of the states of the second and third flags. The reason is as follows: that is, when the upper cover 12 is opened, since there is a possibility that the toner is attached to the photosensitive drum 51 or conveyance belt 73, like a case where a user contacts the photosensitive drum 51 or conveyance belt 73 with a hand having the toner attached thereto, it is necessary to collect the attached toner. Thereby, since it is possible to suppress the sheet S from being stained with the toner attached to the photosensitive drum 51 and the like when the upper cover 12 is opened, it is possible to suppress the image quality from being deteriorated.

On the other hand, during the first collection process (refer to the time point C) after the completion of the moving process, when the user erroneously contacts the power supply switch to thus stop the power feeding and then the power supply switch becomes on to thus resume the power feeding, the color printer 1 starts, as shown in FIG. 4C. At this time, the first flag is set but the second flag is not set. Further, there is no opening/closing history of the upper cover 12. When the first flag is set and there is no opening/closing history of the upper cover 12, the control device proceeds to step S204. Since the second flag is not set (No in S204), the control device 100 starts the first collection process, the second collection process and the holding process (not shown) (S205), as shown in FIG. 4C. Then, after all of the controls are completed, the color printer 1 is subject to a printable state.

Figure 4D:
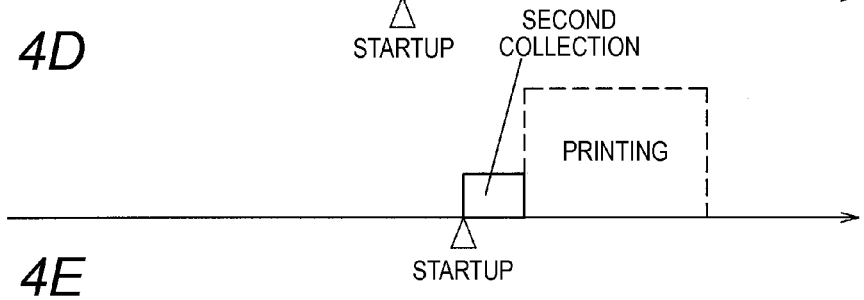

As shown with a time point D of FIG. 4A, during the second collection process after the completion of the first collection process, when the power feeding is interrupted and is then resumed, the color printer 1 starts, as shown in FIG. 4D. At this time, the first and second flags are set but the third flag is not set. Further, there is no opening/closing history of the upper cover 12. When the first and second flags are set and there is no opening/closing history of the upper cover 12, the control device proceeds to step S206. Since the third flag is not set (No in S206), the control device 100 starts the second collection process and the holding process (not shown) (S207, refer to FIG. 2C), as shown in FIG. 4D. Then, after the second collection process and the holding process are completed, the color printer 1 is subject to a printable state.

Figure 4E:
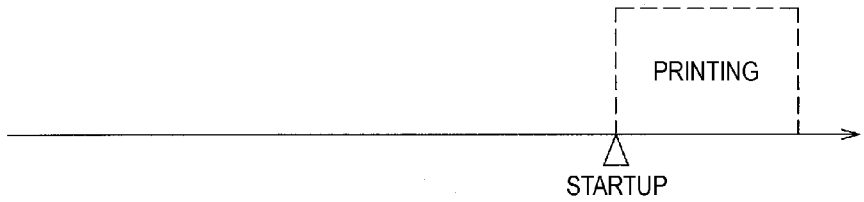

As shown with a time point E of FIG. 4A, during the standby for the input of the print job after the completion of the second collection process, when the power feeding is interrupted and is then resumed, the color printer 1 starts, as shown in FIG. 4E. At this time, the first to third flags are set and there is no opening/closing history of the upper cover 12. When the first and second flags are set and there is no opening/closing history of the upper cover 12, the control device proceeds to step S206. Since the third flag is set (Yes in S206), the control device 100 does not execute any of the moving process, the first collection process, the second collection process and the holding process and ends the processing of the flowchart shown in FIG. 5, and then the color printer 1 is subject to a printable state.

According to this exemplary embodiment as described above, following effects may be obtained.

When the first flag is not set at the startup time, the control device 100 executes the moving process and the collection process (the first collection process and the second collection process) before the printing after the startup, as shown in FIG. 2A or 4B. Therefore, it is possible to reduce the amount of the toner attached to the holding rollers 57, the photosensitive drums 51 and the conveyance belt 73, thereby suppressing the image quality from being degraded. On the other hand, when the first flag is set at the startup time, the control device 100 omits the moving process before the printing after the startup, as shown in FIGS. 2B and 2C or FIGS. 4C to 4E. Therefore, it is possible to reduce the time that is consumed until the color printer 1 is subject to the printable state, compared to the case shown in FIG. 2A or FIG. 4B.

Further, as shown in FIG. 2B, when the first flag is set at the startup time, the control device 100 omits the moving process and executes the holding process and the collection process at the same time before the printing after the startup. Therefore, it is possible to collect the toner on the photosensitive drums 51 by both the holding rollers 57 and the collection unit 90 via the conveyance belt 73 before the printing after the startup. Thereby, it is possible to suppress the image quality from being deteriorated while shortening the time that is consumed until the color printer is subject to the printable state.

Further, as shown in FIG. 2B or FIG. 4C, when the second flag is not set at the startup time, the control device 100 omits the moving process and executes the first collection process and the second collection process before the printing after the startup. Therefore, it is possible to collect the toner attached on the photosensitive drums 51 and the conveyance belt 73. Thereby, it is possible to suppress the image quality from being deteriorated while shortening the time that is consumed until the color printer is subject to the printable state. On the other hand, as shown in FIG. 2C or FIG. 4D, when the second flag is set at the startup time, the control device 100 omits the moving process and the first collection process and executes the second collection process before the printing after the startup. Therefore, it is possible to further shorten the time that is consumed until the color printer is subject to the printable state, compared to the case shown in FIG. 2B or FIG. 4C. Further, it is possible to suppress the image quality from being deteriorated, which is caused as the toner attached on the conveyance belt 73 is attached to the sheet S.

[Second Exemplary Embodiment]

In the below, a second exemplary embodiment of the invention will be described. The configurations and controls of this exemplary embodiment are the same as those of the first exemplary embodiment, except that a part (a condition for unsetting the first flag) of the functions of the control device 100 is different from the first exemplary embodiment.

As shown in FIG. 1, the color printer 1 is configured to execute a color printing and a monochrome printing. Specifically, when executing the color printing, the toner images are formed on all the photosensitive drums 51, the toner images of respective colors are sequentially overlapped and transferred onto the sheet S as the sheet S is conveyed between the photosensitive drums 51 and the conveyance belt 73. On the other hand, when executing the monochrome printing, the toner image is formed on only the photosensitive drum 51 corresponding to black toner, and the black toner image is transferred onto the sheet S as the sheet S is conveyed between the photosensitive drums 51 and the conveyance belt 73.

Like the first exemplary embodiment, the control device 100 is configured to set the first flag when the moving process is completed. In this exemplary embodiment, when executing the color printing, the control device 100 unsets the first flag at the start of the printing operation, like the first exemplary embodiment. When executing the monochrome printing, the control device 100 is configured to hold the first flag as it is set, unlike the first exemplary embodiment. Incidentally, it is possible to determine whether a print is a color printing or monochrome printing, based on an input print job, for example.

Figure 6:
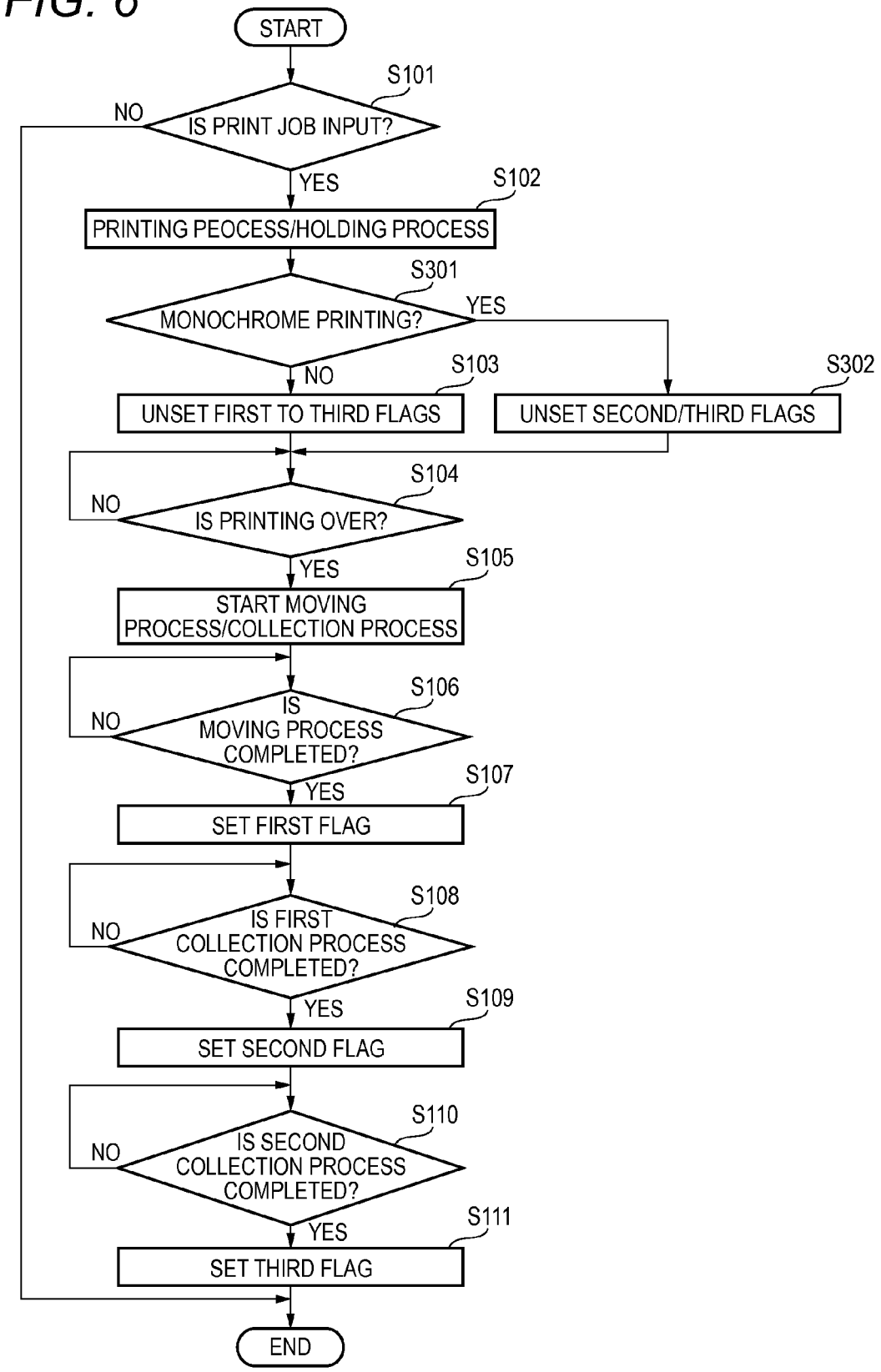
FIG. 6 is a flowchart showing control of a color printer according to a second exemplary embodiment.

After executing the control at the startup time, the color printer 1 of this exemplary embodiment repeatedly executes processing of a flowchart shown in FIG. 6.

As shown in FIG. 6, when a print job is input (Yes in S101), the control device 100 starts the printing control and the holding process (S102). Further, the control device 100 determines whether the input print job is a print job of a monochrome printing or not (S301). When the input print job is not a print job of a monochrome printing (when the input print job is a print job of a color printing) (No in S301), the control device 100 unsets the first to third flags (S 103) and executes processing of step S104 and thereafter.

On the other hand, when the input print job is a print job of a monochrome printing (Yes in S301), the control device 100 unsets the second and third flags, holds the first flag as it is set (S302) and executes processing of step S104 and thereafter. Incidentally, when the input print job is a print job of a monochrome printing, the control device 100 holds the first flag as it is set in step S107.

As shown in FIG. 4A, when a print job of a color printing is input and thus the printing control starts, the first to third flags are unset. In this case, when the upper cover 12 is opened at the time point B1 or B2 and then closed and thus the color printer 1 starts, the control device 100 executes the moving process, the first collection process, the second collection process and the holding process (not shown) (S202, refer to FIG. 2A), as shown in FIG. 4B, like the first exemplary embodiment, because the first flag is not set (No in S201 of FIG. 5).

On the other hand, as shown in FIG. 4A, when a print job of a monochrome printing is input and thus the printing control starts, the second and third flags are unset but the first flag is kept at a set state (refer to a dashed-two dotted line). In this case, for example, when the upper cover 12 is opened at the time point B1 or B2 and then closed and thus the color printer 1 starts, the control device 100 omits the moving process and executes the first collection process, the second collection process and the holding process (not shown) (S205, refer to FIG. 2B), as shown in FIG. 4C, because the first flag is set (Yes in S201) and there is the opening/closing history (Yes in S203). Further, for example, when the power feeding is interrupted at the time point B1 or B2 and then resumed, the control device 100 proceeds to step S204, because the first flag is set (Yes in S201) and there is no opening/closing history (No in S203). Then, since the second flag is not set (No in S204), the control device 100 omits the moving process and executes the first collection process, the second collection process and the holding process (not shown) (S205), as shown in FIG. 4C.

Incidentally, at time points C to E, when the power feeding is interrupted and then resumed and thus the color printer 1 starts or when the upper cover 12 is opened and then closed and thus the color printer 1 starts, the control device 100 executes the same processing as that of the first exemplary embodiment.

As described above, according to this exemplary embodiment, when a print job of a monochrome printing is input, the first flag is always kept at a set state until a print job of a color printing is input. Therefore, the moving process is omitted all the time before the printing after the startup. Hence, it is possible to shorten the time that is consumed until the color printer 1 is subject to a printable state. Incidentally, in the color printer 1, the moving process and the collection process (the first collection process and the second collection process) are always executed after the printing completion. Therefore, even though the moving process before the printing after the startup is omitted every time after a print job of a monochrome printing is input until a print job of a color printing is input, the problem of the deterioration of the image quality is little caused.

[Third Exemplary Embodiment]

In the below, a third exemplary embodiment of the invention will be described. The configurations and controls of this exemplary embodiment are the same as those of the first exemplary embodiment, except that a part (a condition for setting the first flag) of the functions of the control device 100 is different from the first exemplary embodiment.

As shown in FIG. 1, the control device 100 is configured to complete the moving process when preset first time period (in this exemplary embodiment, time period during which the holding roller 57 rotates 15 revolutions, for example) elapses from the start of the moving process. Further, the control device 100 is configured to set the first flag when preset predetermined time period (for example, time during which the holding roller 57 rotates 3 revolutions) elapses from the start of the moving process and to unset the first flag at the start of the printing operation, like the first exemplary embodiment.

Figure 7:
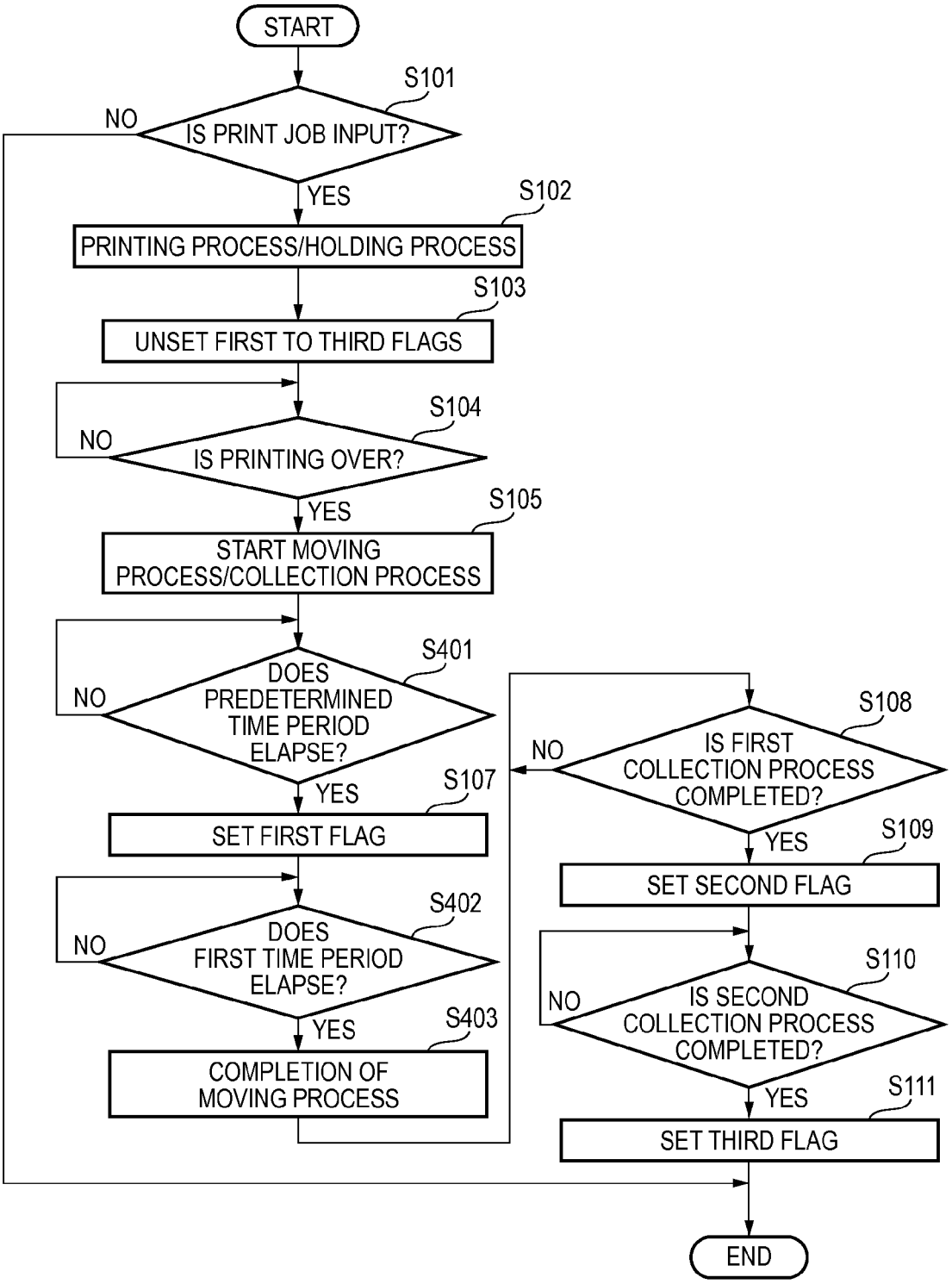
FIG. 7 is a flowchart showing control of a color printer according to a third exemplary embodiment.

The color printer 1 of this exemplary embodiment repeatedly executes processing of a flowchart shown in FIG. 7 after executing the control at the startup time.

As shown in FIG. 7, when a print job is input (Yes in S101), the control device 100 starts the printing control and the holding process (S102) and unsets the first to third flags at the start of the printing operation (S103). Then, when the printing is over (Yes in S104), the control device 100 starts the moving process and the collection process (S105).

After that, when predetermined time period elapses from the start of the moving process (Yes in S401), the control device 100 sets the first flag (S107). Then, when the first time period (first time period>predetermined time period) elapses from the start of the moving process (Yes in S402), the control device 100 completes the moving process (S403) and executes processing of step S108 and thereafter.

At the startup of the color printer 1, the control device 100 executes the same processing as that of the first exemplary embodiment.

Also in this exemplary embodiment as described above, it is possible to obtain the same effects as those of the first exemplary embodiment. Incidentally, briefly speaking, according to this exemplary embodiment, the first flag is set before the moving process is completed. Therefore, the moving process is not completed at the time at which the first flag is set. However, when the holding roller 57 rotates at least one revolution from the start of the moving process, most of the toner held on the holding roller 57 is moved to the photosensitive drum 51. Hence, the amount of the toner that is held on the holding roller 57 is sufficiently reduced at the time at which the first flag is set. Thus, in this exemplary embodiment, even though the printing control and the holding process start after a state where the moving process is omitted before the printing after the startup and the color printer 1 is subject to a printable state, there is little possibility that the holding roller 57 will not be able to completely collect the toner on the photosensitive drum.

Although the exemplary embodiments of the invention have been described, the invention is not limited to the exemplary embodiments. The specific configurations may be appropriately changed without departing from the scope of the invention.

In the above-described exemplary embodiments, as shown in FIG. 2B, when the first flag is set at the startup time of the color printer 1 (image forming apparatus), the control device 100 is configured to omit the moving process and to execute the collection process and the holding process at the same time before the printing after the startup. However, the invention is not limited thereto. For example, when the first flag is set at the startup time of the image forming apparatus, the control device may be configured to omit the moving process and the holding process and to execute only the collection process before the printing after the startup. According to this configuration, the moving process is omitted to shorten the time that is consumed until the image forming apparatus is subject to a printable state. Further, since it is possible to enable the collection member to collect the developer, which is attached on the image carrier, before the printing after the startup, it is possible to suppress the image quality from being deteriorated.

In the above-described exemplary embodiments, the configuration having the first collection roller 91, the second collection roller 92 and the scraping blade 93 has been exemplified as the collection member. However, the invention is not limited thereto. For example, the collection member may be configured only by the scraping blade.

In the above-described exemplary embodiments, the collection member is provided so as to be configured to collect the toner on the photosensitive drum 51 via the conveyance belt 73. However, the invention is not limited thereto. For example, the collection member may be provided to directly collect the toner on the photosensitive drum 51 (developer attached on the image carrier). Specifically, the collection member may be the developing roller supplying the developer to the image carrier, and the like. Incidentally, when the collection member is the developing roller, the toner on the photosensitive drum 51 is removed from the photosensitive drum 51 by the developing roller 53 and is collected into the toner accommodation part 56, which is another example of the collection receptacle, via the supply roller 54 (refer to FIG. 1).

In the above-described exemplary embodiments, the conveyance belt 73 has been exemplified as the endless belt that is opposed to the photosensitive drums 51 (image carriers). However, the invention is not limited thereto. For example, an intermediate transfer belt may be also used.

In the above-described exemplary embodiments, the photosensitive drum 51 has been exemplified as the image carrier on which the developer image is formed. However, the invention is not limited thereto. For example, a photosensitive belt, an intermediate transfer belt, an intermediate transfer drum and the like may be also used.

In the above-described exemplary embodiments, the holding roller 57 has been exemplified as the holding member. However, the invention is not limited thereto. For example, a charge roller and the like may be also used.

In the above-described exemplary embodiments, the color printer 1 having the plurality of photosensitive drums 51 (image carriers) and capable of performing a color printing has been exemplified as the image forming apparatus. However, the invention is not limited thereto. For example, the image forming apparatus may be a printer having one image carrier and capable of performing only a monochrome printing. Further, the image forming apparatus is not limited to the printer and may be a copier, a multi-function device and the like having a document reading device such as flat plate-type scanner.

In the above-described exemplary embodiments, an example where the invention is applied to the image forming apparatus using the positively charged toner (developer) has been exemplified. However, the invention is not limited thereto. That is, the invention can be also applied to an image forming apparatus using negatively charged toner. In this case, the positive and negative of the respective biases are reverse to those of the above-described exemplary embodiments, and a magnitude of the bias is a magnitude of an absolute value thereof.

What is claimed is:

1. An image forming apparatus comprising:

an image carrier configured to carry a developer image;

a holding member configured to hold developer attached on the image carrier and to move the held developer to the image carrier;

a collection member configured to collect the developer attached on the image carrier into a collection receptacle; and a control device configured to execute:

a holding process of holding the developer attached on the image carrier at the holding member;

a moving process of moving the developer held by the holding member to the image carrier; and a collection process of collecting the developer attached on the image carrier into the collection member, the control device being configured to execute the holding process during a printing, and the control device being configured to execute the moving process and the collection process after completion of the printing, wherein the control device is configured to set a first flag when a predetermined time period elapses from a start of the moving process and to unset the first flag at the start of the printing, wherein when the first flag is not set at startup time of the image forming apparatus, the control device is configured to execute the moving process and the collection process before the printing after startup of the image forming apparatus, wherein when the first flag is set at the startup time of the image forming apparatus, the control device is configured to omit the moving process before the printing after the startup, wherein when the first flag is set at the startup time of the image forming apparatus, the control device is configured to execute the collection process before the printing after the startup, wherein the image forming apparatus further comprises:

a plurality of the image carriers; and an endless belt that is opposed to the plurality of the image carriers, wherein the collection member is configured to collect the developer attached on the plurality of the image carriers via the endless belt, wherein, as the collection process, the control device is configured to execute:

a first collection process of moving the developer attached on the plurality of the image carriers to the endless belt; and a second collection process of collecting the developer attached on the endless belt into the collection member, wherein the control device is configured to set a second flag when the first collection process is completed, and wherein when the first flag is set at the startup time of the image forming apparatus, in a case where the second flag is not set, the control device is configured to execute the first collection process and the second collection process before the printing after the startup, and in a case where the second flag is set, the control device is configured to omit the first collection process and to execute the second collection process before the printing after the startup.

2. The image forming apparatus according to claim 1, wherein the plurality of the image carriers is configured to execute a color printing and a monochrome printing, and wherein the control device is configured to:

unset the first flag at the start of the printing when performing the color printing; and hold the first flag as it is set when performing the monochrome printing.

3. The image forming apparatus according to claim 1,
wherein when the first flag is set at the startup time of the image forming apparatus, the control device is configured to execute the collection process and the holding process at the same time before the printing after the startup.

4. The image forming apparatus according to claim 1,
wherein the plurality of the image carriers is configured to execute a color printing and a monochrome printing,
wherein the control device is configured to set a third flag when the second collection process is completed, and
wherein when the first flag and the second flag are set at the startup time of the image forming apparatus,
in a case where the third flag is not set, the control device is configured to execute the second collection process before the printing after the startup, and
in a case where the third flag is set, the control device is configured to omit the moving process, the first collection process, the second collection process and the holding process before the printing operation, and
wherein the control device is configured to:
unset the first flag, the second flag and the third flag at the start of the printing when performing the color printing; and
unset the second flag and the third flag when performing the monochrome printing.

5. The image forming apparatus according to claim 1,
wherein when the predetermined time period elapses, the control device is configured to complete the moving process and to set the first flag.

6. The image forming apparatus according to claim 1,
wherein the control device is configured to set the first flag when the predetermined time period elapses and to complete the moving process when a first time period, which is longer than the predetermined time period, elapses.

7. An image forming apparatus comprising:
an image carrier configured to carry a developer image;
a holding member configured to hold developer attached on the image carrier and to move the held developer to the image carrier;
an endless belt that is opposed to the image carrier;
a collection member configured to collect the developer attached on the image carrier into a collection receptacle via the endless belt; and
a control device configured to execute:
a holding process of holding the developer attached on the image carrier at the holding member;
a moving process of moving the developer held by the holding member to the image carrier; and
a collection process of collecting the developer attached on the image carrier into the collection member,
the control device being configured to execute the holding process during a printing, and
the control device being configured to execute the moving process and the collection process after completion of the printing,
wherein the control device is configured to set a first flag when a predetermined time period elapses from a start of the moving process and to unset the first flag at the start of the printing,
wherein when the first flag is not set at startup time of the image forming apparatus, the control device is configured to execute the moving process and the collection process before the printing after startup of the image forming apparatus,
wherein when the first flag is set at the startup time of the image forming apparatus, the control device is configured to omit the moving process before the printing after the startup,
wherein, as the collection process, the control device is configured to execute:
a first collection process of moving the developer attached on the image carrier to the endless belt; and
a second collection process of collecting the developer attached on the endless belt into the collection member,
wherein the control device is configured to set a second flag when the first collection process is completed, and
wherein when the first flag is set at the startup time of the image forming apparatus,
in a case where the second flag is not set, the control device is configured to execute the first collection process and the second collection process before the printing after the startup, and
in a case where the second flag is set, the control device is configured to omit the first collection process and to execute the second collection process before the printing after the startup.

8. The image forming apparatus according to claim 7,
wherein the image forming apparatus comprises a plurality of the image carriers and is configured to execute a color printing and a monochrome printing, and
wherein the control device is configured to:
unset the first flag at the start of the printing when performing the color printing; and
hold the first flag as it is set when performing the monochrome printing.

9. The image forming apparatus according to claim 7,
wherein when the first flag is set at the startup time of the image forming apparatus, the control device is configured to execute the collection process before the printing after the startup.

10. The image forming apparatus according to claim 7,
wherein when the first flag is set at the startup time of the image forming apparatus, the control device is configured to execute the collection process and the holding process at the same time before the printing after the startup.

11. The image forming apparatus according to claim 9, further comprising:
a plurality of the image carriers,
wherein the collection member is configured to collect the developer attached on the image carriers via the endless belt,
wherein, as the collection process, the control device is configured to execute:
the first collection process of moving the developer attached on the image carriers to the endless belt; and
the second collection process of collecting the developer attached on the endless belt into the collection member.

12. The image forming apparatus according to claim 11,
wherein the image forming apparatus is configured to execute a color printing and a monochrome printing,
wherein the control device is configured to set a third flag when the second collection process is completed, and
wherein when the first flag and the second flag are set at the startup time of the image forming apparatus,
in a case where the third flag is not set, the control device is configured to execute the second collection process before the printing after the startup, and in a case where the third flag is set, the control device is configured to omit the moving process, the first collection process, the second collection process and the holding process before the printing operation, and wherein the control device is configured to:

unset the first flag, the second flag and the third flag at the start of the printing when performing the color printing; and unset the second flag and the third flag when performing the monochrome printing.

13. The image forming apparatus according to claim 7, wherein when the predetermined time period elapses, the control device is configured to complete the moving process and to set the first flag.

14. The image forming apparatus according to claim 7, wherein the control device is configured to set the first flag when the predetermined time period elapses and to complete the moving process when a first time period, which is longer than the predetermined time period, elapses.

15. The image forming apparatus according to claim 7, wherein the control device is configured to set a third flag when the second collection process is completed, and wherein when the first flag and the second flag are set at the startup time of the image forming apparatus, in a case where the third flag is not set, the control device is configured to execute the second collection process before the printing after the startup, and in a case where the third flag is set, the control device is configured to omit the moving process, the first collection process, the second collection process and the holding process before the printing after the startup.

* * * * *